US005570637A

United States Patent [19]

Wagner

[11] Patent Number: 5,570,637

[45] Date of Patent: Nov. 5, 1996

[54] GARAGE FOR A CONTINUOUS CABLE RAILWAY

[75] Inventor: Ruedi Wagner, Rotkreuz, Switzerland

[73] Assignee: Garaventa Holding AG, Goldau, Switzerland

[21] Appl. No.: 544,475

[22] Filed: Oct. 18, 1995

[30] Foreign Application Priority Data

Nov. 8, 1994 [CH] Switzerland ..... 3329/94

[51] Int. Cl.[6] ..... B61B 1/00

[52] U.S. Cl. ..... 104/27; 104/28; 104/184; 104/88.01; 104/88.02; 104/173.2; 104/96; 104/103

[58] Field of Search ..... 104/27, 28, 29, 104/96, 88.01, 88.02, 88.03, 88.04, 88.05, 88.06, 130.01, 130.06, 173.2, 184, 103

[56] References Cited

U.S. PATENT DOCUMENTS

| | | | |
|---|---|---|---|
| 2,688,932 | 9/1954 | Heil | 104/88.02 |
| 3,148,631 | 9/1964 | Gorjanc | 104/88.02 |
| 3,200,766 | 8/1965 | Gorjanc | 104/130.06 |
| 3,334,594 | 8/1967 | Orwin | 104/88.01 |
| 4,265,178 | 5/1981 | Veith | 104/88.01 |
| 4,938,150 | 7/1990 | Gustav et al. | 104/130.06 |
| 4,958,574 | 9/1990 | Meindl | 104/88.02 |
| 5,068,140 | 12/1991 | Glassey | 104/88.01 |
| 5,119,762 | 6/1992 | Lisy | 104/88.01 |

FOREIGN PATENT DOCUMENTS

| | | |
|---|---|---|
| 0245163 | 11/1987 | European Pat. Off. . |
| 0306771 | 3/1989 | European Pat. Off. . |
| 0369981 | 5/1990 | European Pat. Off. . |
| 2496029 | 6/1982 | France . |
| 2654052 | 5/1991 | France . |

*Primary Examiner*—Mark T. Le

*Attorney, Agent, or Firm*—Sughrue, Mion, Zinn, Macpeak & Seas

[57] ABSTRACT

A garage for storing vehicles of a continuous cable railway system. The garage has a plurality of side tracks arranged parallel or substantially parallel to one another to form preferably a rectangular shape. The garage is loaded with vehicles from the station track of the cable railway system over a first feeder track. A second feeder track is used to load the vehicles from the garage to the station track. Conveying units are present at the feeder tracks and side tracks to convey the vehicles. A single junction having two switch units is arranged between the feeder tracks. The junction also allows the vehicles to travel from one of the feeder tracks to the other. Sliding switches, each having an arc-shaped conveyer track, are located on the incoming and outgoing sides of the side tracks. Buffer tracks, each having several stopping points, act as buffers in the feeder tracks for the vehicles when loading or unloading the garage.

17 Claims, 4 Drawing Sheets

GARAGE FOR A CONTINUOUS CABLE RAILWAY

BACKGROUND OF THE INVENTION

1. Field of the Invention

The invention relates to a garage for storing vehicles of a continuous cable railway system which has a station track around which the vehicles drive slowly, are decoupled from the conveying cable, and fed over tracks from the station track to the garage.

2. Description of the Related Art

Cable railway systems have been in use for many years to convey passenger in vehicles, such as cable cars or the like, from a valley station to a mountain station and back again, for example. These valley and mountain stations are typically known as stopping stations.

Such stopping stations of continuous cable railways usually include coupling points on their incoming and outgoing sides, that is, the sides into which and out of which the vehicles are conveyed. At the incoming coupling point, the vehicles conveyed on the conveying cable at up to 6m/sec are decoupled from the cable and slowed to a slow loading velocity of about 0.2 to 0.8 m/sec, at which they drive around a landing on the track path of a station track from the incoming cable side to the outgoing cable side. During this time, passengers can exit or board the vehicle on the landing. At the outgoing coupling point, the vehicles are accelerated and synchronized with movement of the conveying cable and hence coupled again to the cable.

To change the number of used vehicles in a continuous cable railway to achieve a desired transport capacity, unused vehicles are typically parked momentarily on the side tracks of garages at the stopping station. The garaging capacity can be designed for all the vehicles which are side-tracked to protect them from the weather when taken out of operation from the cable railway system.

The side tracks of known garages are mostly loop-shaped, are loaded from the station track over an incoming switch and unloaded over an outgoing switch as described, for example, in European Patent Applications EP 306 771 B1 and EP 245 163 B1, as well as French Patent Application FR 24 96 029. The loop shape has an advantage that the side tracks can typically fit in existing side track areas. However, such side tracks cannot be loaded easily.

That is, the vehicles must exit the garage in the same sequence in which they entered it. The utilization of space in such garages is not optional due to the broad semi-circular arch that the vehicles must be driven through.

A garage with the features noted above which is disclosed in EP 369 981 B1 has only a single feeder track, the conveying direction of which from the station track to the side tracks for loading and unloading with vehicles is reversible. To load the station track with vehicles from the side tracks, the cable railway conveys in the normal operational direction. However, the conveying direction on the cable railway system must be reversed to load the vehicles onto the side tracks. This disrupts the normal operation of the system.

Also, when the transport capacity need only be momentarily changed, only individual vehicles should be taken from the cable railway operation. To perform this, a switch to the feeder track is arranged on the station track and each side track. Thus, a flexible loading and unloading of the side tracks is possible in this conventional garage. Also, this arrangement is more favorable in contrast to the loop shaped side tracks. That is, in this arrangement, the parallel side tracks can be set more closely together, since only a quarter circle arc must be driven at the switch in each case.

However, it is still desirable to achieve flexible loading and unloading of the side track without disrupting the normal operation of the cable railway system.

SUMMARY OF THE INVENTION

To achieve this object, the present invention includes a garage having a separate feeder track which always conveys the vehicles in only one direction to load the side tracks from the station track. Also, another separate feeder track is provided for loading the station track from the side tracks. A junction controlled with two switch units is located between the feeder track for loading the station track and the feeder track for unloading the station track.

The vehicle used in the invention could be gondolas, chairs, and similar items or the like, which can be coupled over a suspension tackle with at least one cable clamp on the conveying cable of the cable railway system. To always convey such vehicles forward in the direction of travel with continuous transporters, the suspension tackle of each vehicle must be conducted into the garage over one track before entering and out of the garage over another track when exiting.

In the present invention, that conduction occurs at the junction between the two feeder tracks. At this point, if the vehicle is, for example, entering the garage on one track, it crosses the other track on which vehicles exit the garage. Likewise, if a vehicle is exiting the garage, it crosses the track on which vehicles enter the garage.

Each switch unit in the present invention has two connection pieces to engage one or the other feeder track. The connection pieces are arranged so that when one of them engage the feeder track and the garage track to allow conduction of the vehicle into the garage, for example, the other connection is not engaged with the other feeder track and thus creates an opening through which the suspension tackle passes. With this arrangement, in the present invention, the vehicles which are conveyed with continuous transporters can always be conveyed in a forward direction of travel when entering and exiting the garage.

The conveying units are typically conventional units such as cable conveyors, chain conveyors, ramp transporters or the like, which engage interlockingly with the suspension tackle of the vehicle. Pneumatic wheel transporters or the like, for example, drive the cables, chains or the like of the conveyors, so that the conveyors are conveyed in any desired direction, such as linearly or at an arc. Also, if gondolas, for example, are employed as the vehicles, the pneumatic wheel transporter and conveyors can also drive the vehicles by frictionally engaging the floors of the vehicles. On the connection points between adjacent conveyor units, the vehicles are transferred either by frictional engagement or by interlocking with the subsequent conveyor.

The garage of the present invention includes a plurality of tracks which are arranged parallel or substantially parallel with each other. Preferably, an arc-shaped sliding switch is driven along the open ends of the tracks in a direction normal or substantially normal to the lengths of the tracks. The arc-shaped switch aligns with a particular track when vehicles are to be loaded onto or from that track, thereby coupling either the garage entry feeder track or garage exit feeder track to the individual side tracks to enable the vehicle to either enter the side track or exit the side track as desired. The arc-shaped conveyor thus provides an efficient and economical solution for loading a garage having, for example, more than three or four side tracks.

The garage of the present invention also includes buffer tracks having defined stopping points for several vehicles. Each buffer track is arranged on each feeder track between adjacent conveying units. Individually controllable drives define several stopping points in each buffer track for vehicles following in series. The buffer track arranged on the feeder track which feeds the station track forms a follow-up buffer, from which conveying can be conducted in the direction of the station track as long as the sliding switch is positioned on the side tracks.

After the vehicles on the buffer track are loaded onto the side tracks, the buffer tracks are again filled with vehicles as desired and the loading process continues. Similarly, the buffer track arranged on the feeder track which feeds the station track forms a preliminary buffer which is filled repeatedly with vehicles when the sliding switch is positioned on the side tracks to enable the vehicles to be unloaded from the side tracks, into the buffer, and onto the station track. The buffer loading the station track is preferably timed by a control line from the station track, which provides a measured supply of vehicles into a space present on the conveying cable.

In another embodiment of the invention, a connection track is present to allow passage of the vehicles from one feeder track to another feeder track without the vehicles being loaded onto and from the side tracks in the garage. A vehicle waiting on the feeder track which is used to unload the garage can thus immediately be brought again onto the feeder track which is used to load the garage, and can then be parked on one of the side tracks without passing onto the cable railway.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which.

DETAILED DESCRIPTION OF THE PREFERRED EMBODIMENT

Figure 1A:
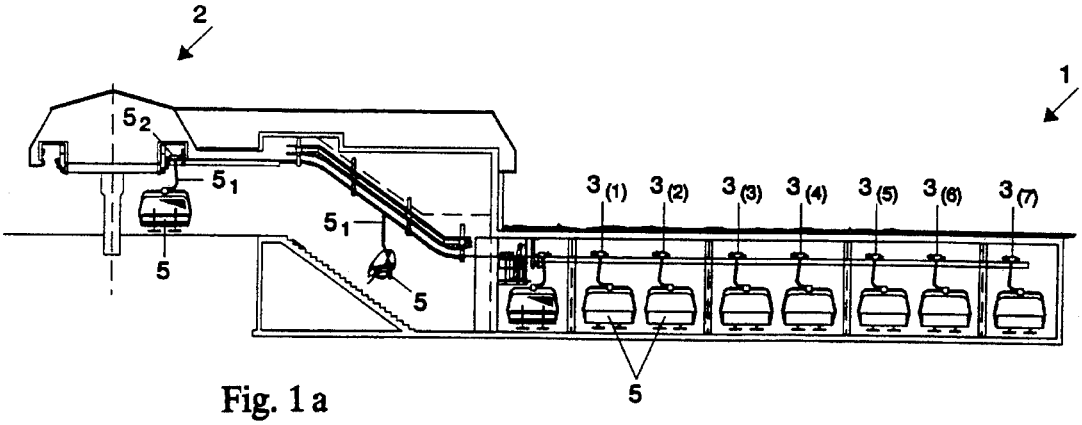
FIG. 1*a* is a side view of an embodiment of the garage in accordance with the invention.
Figure 1B:
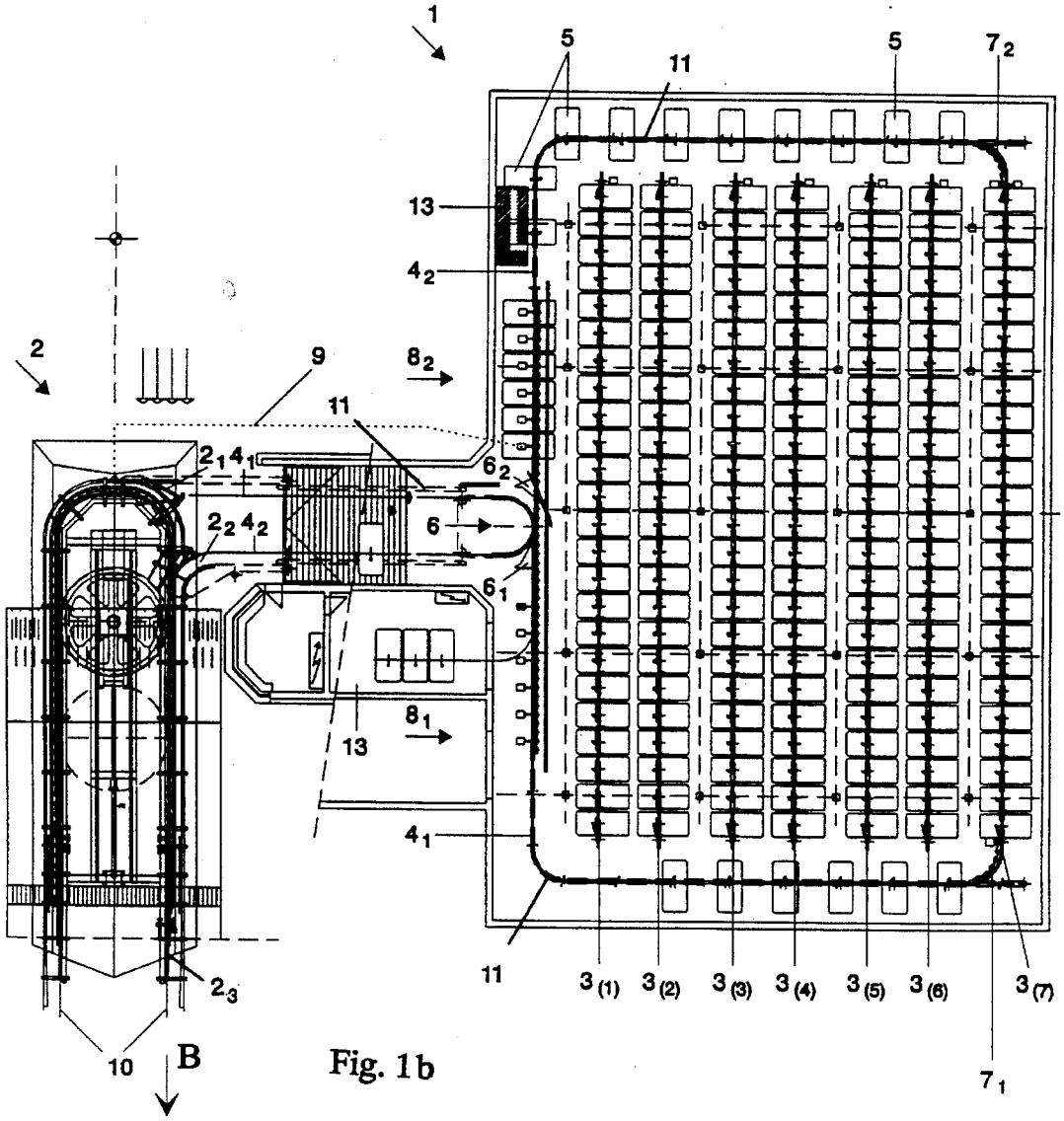
FIG. 1*b* is a top view of the embodiment of the garage shown in FIG. 1*a*.

FIGS. 1*a* and 1*b* show a stopping station 2 of a continuous cable railway in accordance with an embodiment of the present invention. Stopping station 2 is, for example, the valley station of a railway having four-seat vehicles 5. Vehicles 5 are uncoupled when entering the stopping station 2 from conveying cable 10 and slowed to a comparatively slow driving velocity, at which they drive in, for example, a clockwise direction around the landing of the stopping station 2 on the station track $\mathbf{2}_3$ of the station 2, as shown in FIG. 1*b*. At this slow velocity, passengers (e.g., up to four) can board the vehicle 5 before the vehicle 5 accelerates to the cable conveying velocity, is coupled to the conveying cable 10, and drives out of the stopping station in the direction of arrow B toward the mountain. Of course, the vehicles can be driven around the landing in a counter-clockwise direction and at any suitable speed, and accomodate any practical number of passenger.

Next to the station track $\mathbf{2}_3$, a garage 1 is located, for example, under the ground. The garage 1, however, could be at any practical location with respect to the station 2. In the garage 1, even parallel side tracks $\mathbf{3}_{(1)}$ to $\mathbf{3}_{(7)}$ are arranged in a rectangular manner parallel or substantially parallel to each other and have open track ends at their opposite sides. The garage 1 is coupled to the station track $\mathbf{2}_3$ by two feeder tracks $\mathbf{4}_1$ and $\mathbf{4}_2$, on which the vehicles 5 are conveyed.

The feeder track $\mathbf{4}_1$, which is used to load the garage, extends from the station track $\mathbf{2}_3$ over an outgoing switch $\mathbf{2}_1$. The feeder track $\mathbf{4}_2$, which loads station track $\mathbf{2}_3$ from the garage 1, has an incoming vehicle switch $\mathbf{2}_2$ which is arranged forward in the direction of travel in relation to the outgoing switch $\mathbf{2}_1$ of the track of the station track $\mathbf{2}_3$. Both feeder tracks $\mathbf{4}_1$ and $\mathbf{4}_2$ extend past the open track ends of the seven side tracks $\mathbf{3}_{(1)}$ to $\mathbf{3}_{(7)}$ on opposite sides of and at right angles or substantially right angles to the seven side tracks. The amount of side tracks could be any practical number, as desired.

Between the open track ends of the side tracks $\mathbf{3}_{(1)}$ to $\mathbf{3}_{(7)}$ and the feeder track $\mathbf{4}_1$ or $\mathbf{4}_2$, a sliding switch $\mathbf{7}_1$ or $\mathbf{7}_2$ can be positioned and stopped relative to each side track $\mathbf{3}_{(1)}$ to $\mathbf{3}_{(7)}$ onto which or from which a vehicle is to be loaded or unloaded. The vehicles 5 are conveyed over a quarter or substantially quarter circle arc of the sliding switches $\mathbf{7}_1$ or $\mathbf{7}_2$ onto or off of each of the side tracks $\mathbf{3}_{(1)}$ to $\mathbf{3}_{(7)}$ as the sliding switches $\mathbf{7}_1$ or $\mathbf{7}_2$ are positioned relative to each of the side tracks $\mathbf{3}_{(1)}$ to $\mathbf{3}_{(7)}$.

Conveying units 11, such as cable conveyors, chain conveyors, ramp transporters, or the like, are arranged on both feeder tracks $\mathbf{4}_1$ and $\mathbf{4}_2$, and on the side tracks $\mathbf{3}_{(1)}$ to $\mathbf{3}_{(7)}$. The conveying units 11 engage with either the suspension tackle $\mathbf{5}_1$ or a cable clamp $\mathbf{5}_2$ coupled to the suspension tackle $\mathbf{5}_1$ of the vehicle 5 to convey the vehicle 5.

A single junction 6 is disposed between the two feeder tracks $\mathbf{4}_1$ and $\mathbf{4}_2$ and is controlled by two switch units $\mathbf{6}_1$ and $\mathbf{6}_2$. If the feeder track $\mathbf{4}_1$ for loading the garage is traveled by vehicles 5, then the associated switch unit $\mathbf{6}_1$ is set in the junction 6 and connects the adjacent conduction rails of the feeder track $\mathbf{4}_1$, while the other switch unit $\mathbf{6}_2$ is not engaged to free a space in the other conduction rail of the feeder track $\mathbf{4}_2$ which loads the station track $\mathbf{2}_3$, so the suspension tackle $\mathbf{5}_1$ can pass through that space.

Likewise, if the feeder track $\mathbf{4}_2$ for emptying the garage is traveled by vehicles 5, then the associated switch unit $\mathbf{6}_2$ is set on the junction 6 and connects the adjacent conduction rails of the feeder track $\mathbf{4}_2$, while the other switch unit $\mathbf{6}_1$ is not engaged to free a space in the other conduction rail of the feeder track $\mathbf{4}_1$ which loads garage 1, so the suspension tackle $\mathbf{5}_1$ can pass through. Furthermore, at the junction 6, a straight connection and thus passage of a vehicle 5 from feeder track $4_1$ to feeder track $4_2$ is possible in the direction of conveying (i.e., counterclockwise) or opposite to the direction of conveying (i.e., clockwise) when both switch units $6_1$ and $6_2$ are set.

In the embodiment shown in FIG. 1*b*, in particular, both feeder tracks $4_1$ and $4_2$ extend parallel or substantially parallel to one another and perpendicular to the side tracks $3_{(1)}$ to $3_{(7)}$ in the area between the station 2 and garage 1. They are each curved and thus deflected at a right or substantially right angle at the junction 6.

The feeder tracks $4_1$ and $4_2$ then extend away from each other along the length of the side tracks $3_{(1)}$ to $3_{(7)}$ and parallel or substantially parallel to the side tracks $3_{(1)}$ to $3_{(7)}$ to opposite ends of the side tracks. The feeder tracks $4_1$ and $4_2$ are then each curved and thus deflected at a right or substantially right angle and extend past opposing open ends of the side tracks $3_{(1)}$ to $3_{(7)}$.

For continuous loading of the station track $2_3$, as well as the side tracks $3_{(1)}$ to $3_{(7)}$, with the vehicles 5 being conveyed by conveying units 11, two buffers are provided. That is, a congestion track $8_1$, which can accommodate a plurality of vehicles 5 (e.g., six vehicles), is arranged in front of the junction 6 in the direction of conveying for the feeder track $4_1$ which loads the garage 1. Also, a congestion track $8_2$, which accommodates vehicles 5 to be loaded onto the station track $2_3$, is monitored by a control line 9 from the station track $2_3$.

The control of the congestion tracks $8_1$ and $8_2$ is explained in more detail with reference to FIG. 2. On both feeder tracks $4_1$ and $4_2$, every six individual controllable individual drives $8_{11}$ and $8_{16}$ or $8_{21}$ to $8_{26}$ define in each case six stopping points arranged sequentially one after one another for six vehicles $5_{(1)}$ to $5_{(6)}$ on the congestion tracks $8_1$ or $8_2$. The individual drives $8_{11}$ to $8_{16}$ or $8_{21}$ to $8_{26}$ include, for example, pneumatic wheels which frictionally engage the cable clamps $5_2$ of the vehicles 5 to move the vehicles along the tracks.

The congestion track $8_2$ in the feeder track $4_2$, from which the vehicles 5 are fed to the station track $2_3$, serves as a follow-up buffer. The congestion track $8_1$, arranged in the feeder track $4_1$ and from which the vehicles 5 are fed to the garage 1, serves as a preliminary buffer.

Figure 2:
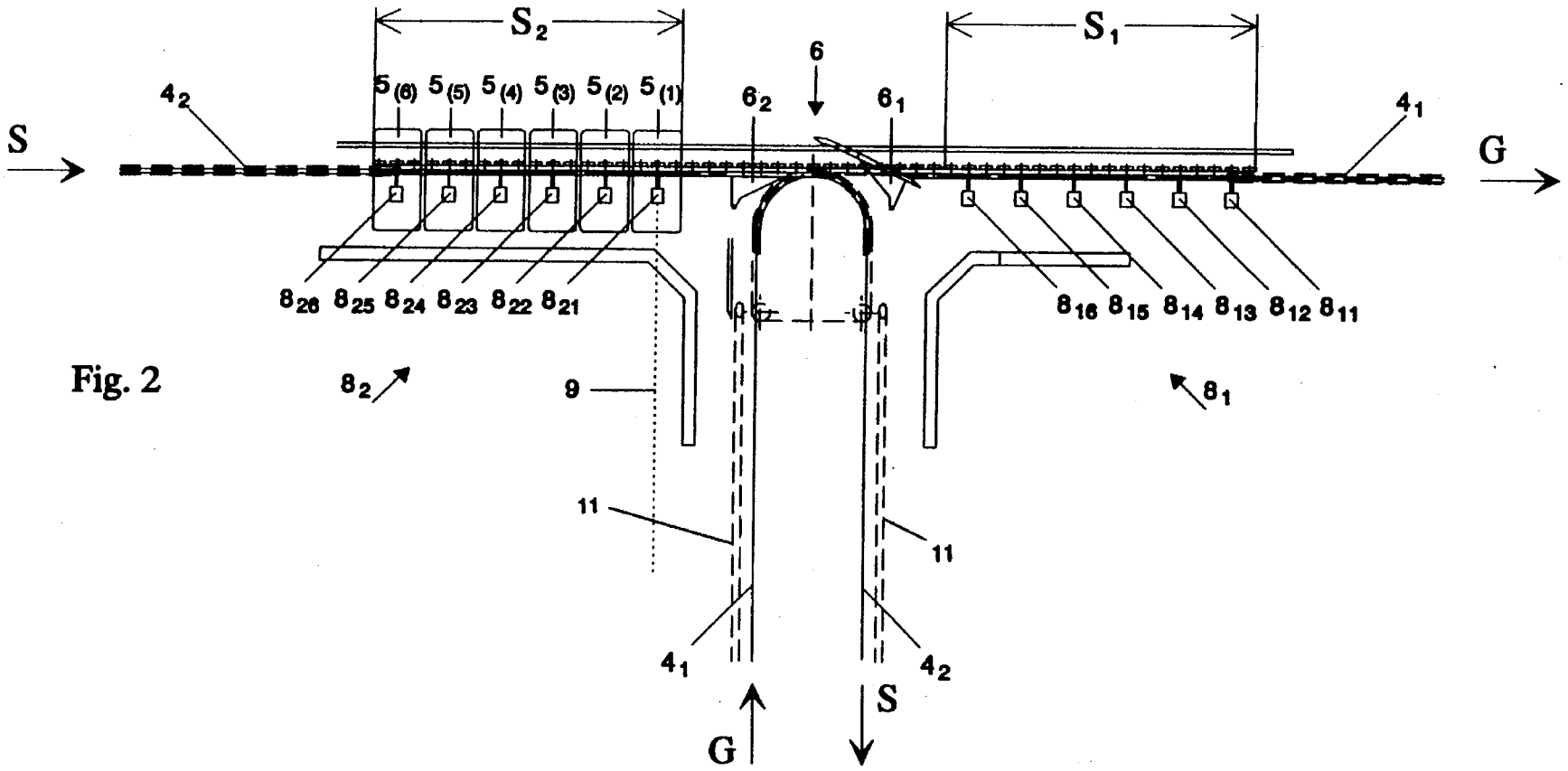
FIG. 2 illustrates a top view of an embodiment of the junction between the two feeder tracks and the buffer tracks of the embodiment of the present invention as shown in FIGS. 1*a* and 1*b;*

For the station track $2_3$ loading operation, as shown in FIG. 2, all the conveying units 11 of the feeder track $4_2$ for loading the vehicles 5 onto the station track $2_3$ are put in operation, convey in the direction of arrow S, and the switch unit $6_2$ belonging to the feeder track $4_2$ is set. The conveying units 11 of the other feeder track $4_1$ are not required, and therefore are purposefully stalled or side tracked. Moreover, the switch unit $6_1$ for the feeder track $4_1$ in junction 6 is not engaged.

Before the station track $2_3$ is loaded, the buffer or congestion track $8_2$ must first be filled with a plurality of vehicles (e.g., six) $5_{(1)}$ to $5_{(6)}$. Of course, the congestion track $8_2$ could be configured to accommodate any practical number of vehicles.

As soon as the congestion track $8_2$ is full with six vehicles $5_{(1)}$ to $5_{(6)}$, the timing series maintained over the control line 9 from the station 2 controls the individual driver $8_{21}$ which is in the front of the congestion track $8_2$ in the conveying direction S, so that the vehicle $5_{(1)}$ is conveyed in the direction S toward the station track $2_3$. During this time, the congestion track $8_2$ is filled again from the rear with another vehicle 5. If one of the side tracks $3_{(1)}$ to $3_{(7)}$ becomes completely emptied, the associated sliding switch $7_2$ travels to another side track, the congestion track $8_2$ is filled with vehicles from that side track, and those vehicles are thus loaded onto the station track $2_3$.

In this type of operation, all the vehicles 5 from the garage 1 can be coupled in continuous series to the conveying cable 10 when beginning operation of the cable railway system. However, it is also possible, if necessary or desirable, to only put some of the vehicles 5 in operation and to suspend them at correspondingly large distances from one another on the conveying cable 10. The gap between the vehicles 5 can then be filled when a higher transport capacity is required on the cable railway system.

The garage loading operation is similar to the station loading operation described above. However, in this operation, the vehicles run in the direction of arrow G. First, the buffer of the congestion track $8_1$ must be filled with a plurality of vehicles 5 (e.g., six). Then, a side track $3_{(1)}$ is loaded by starting the operation of the associated conveyer. That is, a start signal for loading the garage 1 is given to the last individual driver $8_{11}$ in the conveying direction toward the garage, as soon as a vehicle 5 stands at that stopping point. The driver $8_{11}$ thus conveys the vehicle 5 further along the feeder track $4_1$ so it can be loaded onto one of the side tracks, depending on the position of the sliding switch $7_2$.

For example, the sliding switch $7_2$ can first be aligned with side track $3_{(1)}$. When the side track $3_{(1)}$ becomes filled with vehicles 5, the sliding switch $7_1$ travels to another side track. In this type of operation, all the vehicles 5 situated on the conveying cable 10 can be garaged when ceasing operation of the cable railway system. However, if desired, only every several vehicles 5 (e.g., every second or third vehicle 5) situated on the conveying cable 10 may garaged so as to adapt to the transport capacity required in a certain situation. In this type of operation, it is also possible to collect vehicles requiring servicing on one of the side tracks $3_{(1)}$ before they are transferred to a servicing station 13 arranged on the feeder track $4_2$. Furthermore, the continuous conveying units 11 on the feeder track $4_1$ or $4_2$ and on the side tracks $3_{(1)}$ to $3_{(7)}$ can work with different conveying velocities, so that the vehicles are conveyed at different distances between each other.

Figure 3A:
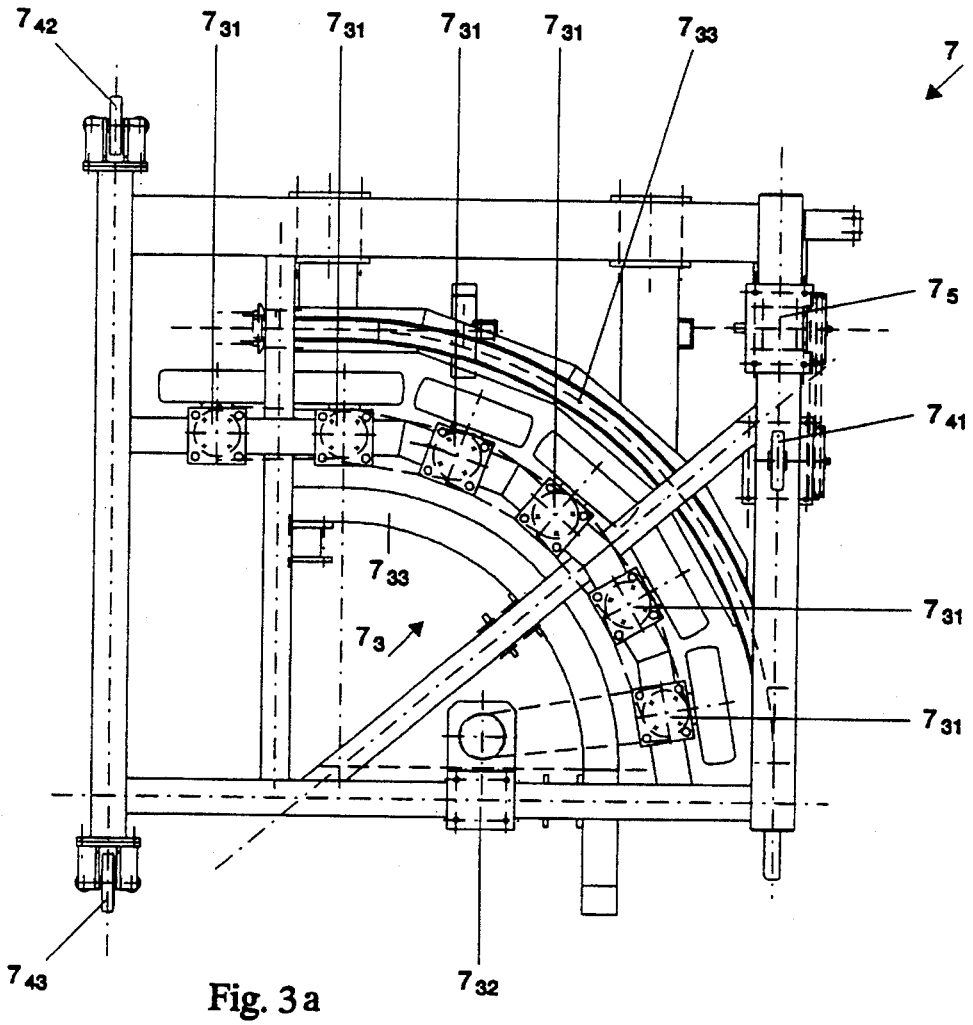
FIG. 3*a* shows a top view of an embodiment of the sliding switch having an arc-shaped conveyor according to the present invention.
Figure 3B:
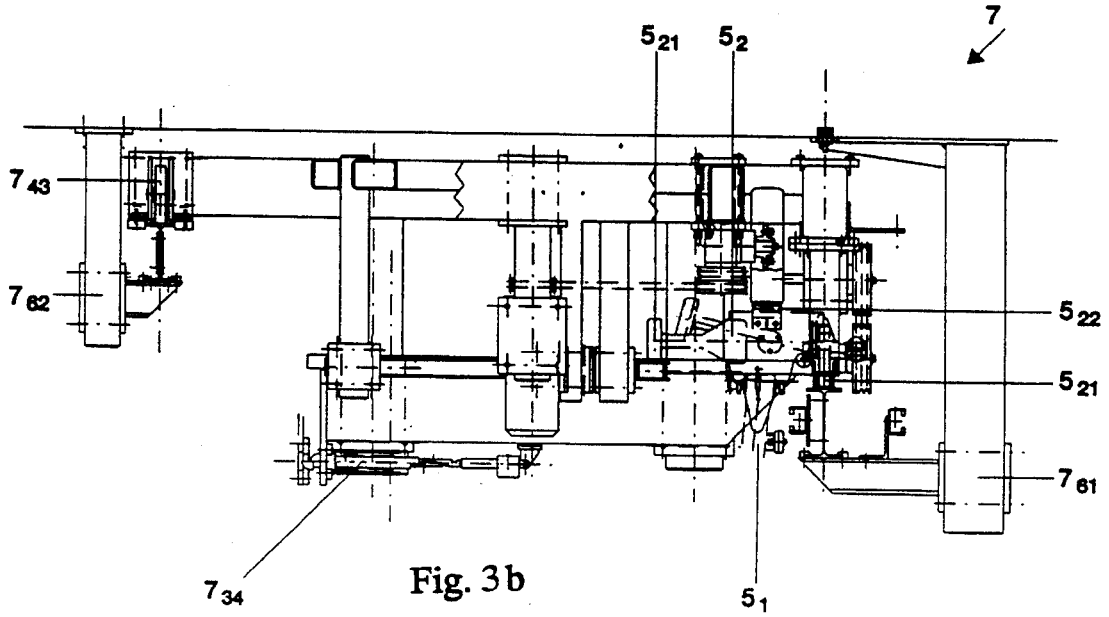
FIG. 3*b* illustrates a front view of an embodiment of the sliding switch shown in FIG. 3*a;*
Figure 4A:
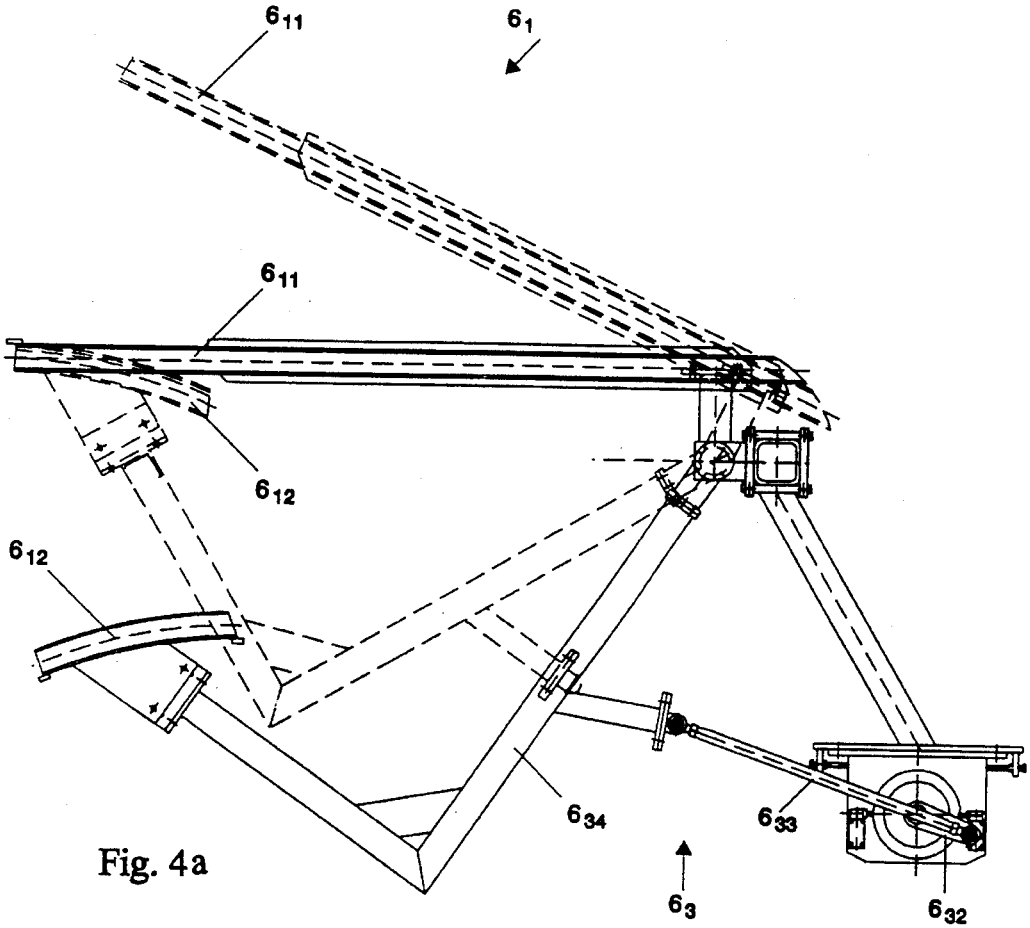
FIG. 4*a* shows a top view of an embodiment of a driver of the present invention employed for each of the switch units at the junction shown in FIG. 2.
Figure 4B:
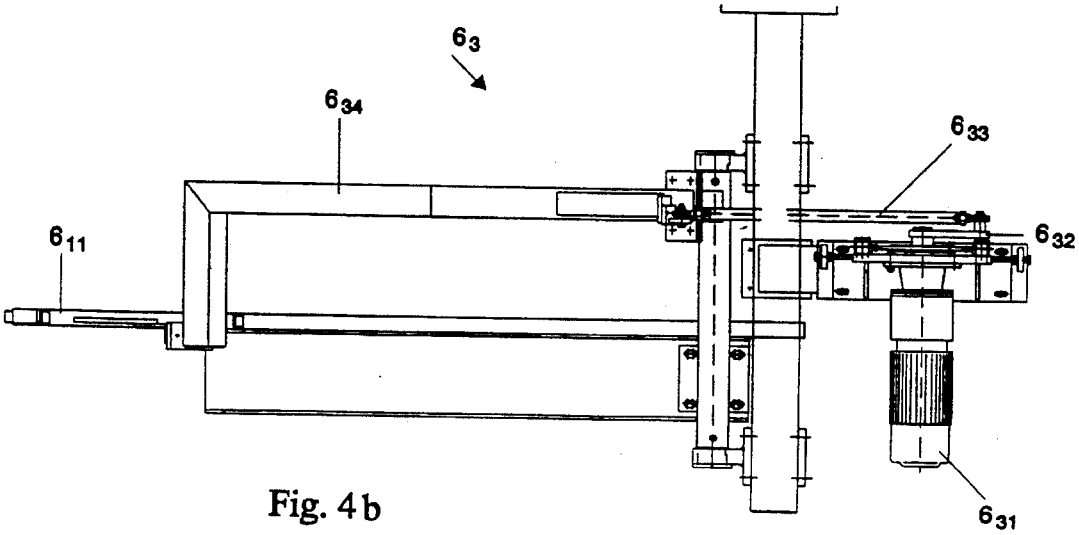
FIG. 4*b* illustrates a side view of the driver shown in FIG. 4*a*.

An embodiment of the sliding switches $7_1$ or $7_2$ will now be discussed with reference to FIGS. 3*a* and 3*b*. For convenience, these switches will be referenced simply as switch 7.

As shown, each switch 7 includes three running wheels $7_{41}$ to $7_{43}$, arranged on a frame having two running rails $7_{61}$ and $7_{62}$, which extend past one side of open ends of the side tracks $3_{(1)}$ to $3_{(7)}$ and thus enable the switch 7 to travel past the open ends of the side tracks $3_{(1)}$ to $3_{(7)}$. An individual driver $7_5$, such as a motor-pulley arrangement or the like, drives running wheel $7_{41}$ on the running rail $7_{61}$.

At each side track $3_{(1)}$ as desired, the switch 7 is stopped by an arresting apparatus $7_{34}$, which can be any type of brake mechanism. An arc-shaped conveyor $7_3$ includes, for example, six pneumatic wheel drives $7_{31}$ which frictionally engage access bridges $5_{22}$ which are fixed to the cable clamps $5_2$, thereby driving the cable clamps $5_2$ and their associated vehicles 5 to roll along two running rails $7_{33}$ and from the switch 7 onto the side track $3_{(1)}$. Of course, any suitable number of wheel drives, rails, etc. can be used. The pneumatic wheel drivers $7_{31}$ are driven synchronously as desired by a single driver $7_{32}$ via traction cables or the like.

In a similar manner, when vehicles are loaded from a side track, for example, $3_{(1)}$ onto a switch 7, the vehicles are conveyed from the side track by a conveyor 11 associated with that side track, and are loaded onto the switch 7. The wheel drives $7_{31}$ frictionally engage the access bridges $5_{22}$ which are fixed to the cable clamps $5_2$, thereby driving the cable clamps $5_2$ and their associated vehicles 5 to roll along two running rails $7_{33}$, over the switch 7 and onto the corresponding feeder track (e.g., feeder track $4_2$).

The driver of the switch units $6_1$ and $6_2$ in the junction 6 will now be discussed with reference to FIGS. *4a* and *4b*. For simplicity, only switch unit $6_1$ will be discussed. However, both switch units $6_1$ and $6_2$ include identical or substantially identical components.

In feeder track $4_1$ (or $4_2$), a straight piece $6_{11}$ and an arced piece $6_{12}$ are inserted as a connection piece for controlling the junction 6 on the switch unit $6_1$ (and $6_2$). The straight piece $6_{11}$ creates the connection to the conduction rails of the feeder track $4_1$ loading the garage 1. The arced piece $6_{12}$ couples the feeder track $4_1$ to the feeder track $4_2$ when inserted in the feeder track $4_1$. When neither straight piece $6_{11}$ or arced piece $6_{12}$ are inserted in the feeder track $4_1$, a space remains in the feeder track $4_1$ for the passage of the suspension tackle $5_1$.

As stated above, the switch $6_2$ associated with feeder track $4_2$ operates in a similar manner with respect to feeder track $4_2$.

The driving takes place over a pivoted link comprising a drive motor $6_{32}$, coupler $6_{33}$ and link $6_{34}$. The straight piece $6_{11}$ and the arced piece $6_{12}$ are connected tightly with the line $6_{32}$, coupler $6_{33}$ and link $6_{34}$. The position of the straight piece $6_{11}$ in contact with the feeder track $4_1$ is depicted in FIG. *4a* with unbroken and dashed lines, and its position when it is not in contact with feeder track $4_1$ is depicted with dashed lines only. At link $6_3$, the coupler $6_{33}$ swivelably engages with the drive crank $6_{32}$ by a crank pin so that it can rotate. This rotation causes the movement of the straight piece $6_{11}$ and arced piece $6_{12}$ into and out of connection with the feeder track $4_1$.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A garage for vehicles of a continuous cable railway system, comprising:

at least one side track;

a garage loading feeder track which loads the vehicles onto the at least one side track from the continuous cable railway system;

a garage unloading feeder track which unloads the vehicles from the at least one side track onto the continuous cable railway system; and a junction comprising a first switch unit having a first portion which directs said vehicles to continue traveling on said garage loading feeder track and a second switch unit having a second portion which directs said vehicles to continue traveling on said garage unloading feeder track, said first switch unit further having a third portion which couples with said garage loading feeder track to direct said vehicles traveling on said garage loading feeder track to travel onto said garage unloading feeder track, and said second switch unit further having a fourth portion which couples with said garage unloading feeder track to direct said vehicles traveling on said garage unloading feeder track to travel onto said garage loading feeder track.

2. A garage as claimed in claim 1, wherein said garage loading feeder tracks allows the vehicles travelling thereon to travel in only on direction, and said garage unloading feeder track allows the vehicles travelling thereon to travel only in another direction.

3. A garage as claimed in claim 1, wherein said at least one side track is a plurality of side tracks, and further comprising:

a first movable switch which cooperates with the garage loading feeder track to load said vehicles onto selected ones of said side tracks; and a second movable switch which cooperates with the garage unloading feeder track to unload said vehicles from selected ones of said side tracks.

4. A garage as claimed in claim 3, wherein said plurality of side tracks are disposed parallel or substantially parallel to each other in series in a widthwise direction.

5. A garage as claimed in claim 3, wherein said first movable switch comprises a first arced-shaped track on which said vehicles are conveyed to load said vehicles onto said selected ones of said side tracks, and said second movable switch comprises a second arced-shaped track on which said vehicles are conveyed to unload said vehicles from said selected ones of said side tracks.

6. A garage as claimed in claim 1, wherein said garage loading feeder track includes a first buffer portion which temporarily stores at least one of said vehicles when said vehicles are being loaded onto said at least one side track, and said garage unloading feeder track includes a second buffer portion which temporarily stores at least one of said vehicles when said vehicles are being unloaded from said at least one side track and before said vehicles are loaded onto said cable railway system.

7. A garage as claimed in claim 1, further comprising conveyors which convey said vehicles along said garage loading and unloading feeder tracks.

8. A garage as claimed in claim 1, further comprising a controller which controls said first switch unit to couple said first portion with said garage loading feeder track to direct said vehicles traveling on said garage loading feeder track to continue travelling onto said garage loading feeder track, controls said first switch unit to couple said third portion with said garage loading feeder track to direct said vehicles traveling on said garage loading feeder track to travel onto said garage unloading feeder track, controls said second switch unit to couple said second portion with said garage unloading feeder track to direct said vehicles traveling on said garage loading feeder track to continue traveling onto said garage unloading feeder track, and controls said second switch unit to couple said fourth portion with said garage loading feeder track to direct said vehicles traveling on said garage unloading feeder track to travel onto said garage loading feeder track.

9. A garage as claimed in claim 1, further comprising:

a first uncoupling switch which uncouples said vehicles from a continuous cable of said railway system and directs said uncoupled vehicles onto said garage loading feeder track; and a second uncoupling switch which uncouples said vehicles from said garage unloading feeder track and couples said uncoupled vehicles onto said continuous cable.

10. A garage for vehicles of a continuous cable railways system, comprising:

at least one side track;

a garage loading feeder track which loads the vehicles onto the at least one side track from the continuous cable railway system, said garage loading feeder track including a first buffer portion which temporarily stores at least one of said vehicles when said vehicles are being loaded onto said at least one side track;

a garage unloading feeder track which unloads the vehicles from the at least one side track onto the continuous cable railway system, said garage unloading feeder track including a second buffer portion which temporarily stores at least one of said vehicles when said vehicles are being unloaded from said at least one side track and before said vehicles are loaded onto said cable railway system, said first and second buffer portions each including conveyors;

a junction comprising a first switch unit having a first portion which directs said vehicles to continue traveling on said garage loading feeder track and a second switch unit having a second portion which directs said vehicles to continue traveling on said garage unloading feeder track; and a controller which controls said conveyors to load said vehicles into and out of said first and second buffer portions.

11. A method for garaging vehicles of a continuous cable railway system, comprising the steps of:

uncoupling the vehicles from a cable of the railway system;

first directing the vehicles onto a garage loading feeder track;

second directing the vehicles from the garage loading feeder track onto at least one side track disposed in said garage;

directing some of said vehicle from said garage loading feeder track directly to said garage unloading feeder track without loading said some of said vehicles onto said at least one side track;

third directing vehicles loaded on the at least one side track onto a garage unloading feeder track which is separate from said garage loading feeder track; and coupling the vehicles traveling on the garage unloading feeder track onto the cable.

12. A method as claimed in claim 11, wherein:

said at least one side track is a plurality of side tracks;

said second directing step comprises the steps of positioning said vehicles proximate to an end of a selected one of said plurality of side track, and directing said vehicles from said garage loading feeder track onto said selected side track.

13. A method as claimed in claim 12, further comprising the step of initially arranging said plurality of side tracks parallel or substantially parallel to each other in series in a widthwise direction.

14. A method as claimed in claim 11, wherein said garage loading and unloading feeder tracks each include an opening therein, said first directing step comprises a step of conveying said vehicles on said garage loading feeder track and through said opening in said garage unloading feeder track, and said third directing step comprises a step of conveying said vehicles on said garage unloading feeder track and through said opening in said garage loading feeder track.

15. A method as claimed in claim 11, wherein said first directing step comprises a step of conveying said vehicles on said garage loading feeder track in only one first conveying direction, and said third directing step comprises a step of conveying vehicles on said garage unloading feeder track in only one second conveying direction.

16. A method for garaging vehicles of a continuous cable railway system, comprising the steps of:

uncoupling the vehicles from a cable of the railway system;

first directing the vehicles onto a garage loading feeder track;

after said first directing step, first holding said vehicles in a first buffer location on said garage loading feeder track for a predetermined period;

second directing the vehicles from the garage loading feeder track onto at least one side track disposed in said garage;

third directing vehicles loaded on the at least one side track onto a garage unloading feeder track which is separate from said garage loading feeder track;

after said third directing step, second holding said vehicles in a second buffer location on said garage unloading feeder track for a second predetermined period; and coupling the vehicles traveling on the garage unloading feeder track onto the cable.

17. A method as claimed in claim 16, further comprising the steps of conveying said vehicles into and out of said first and second buffer locations.

* * * * *